US009958808B2

(12) United States Patent
Horii et al.

(10) Patent No.: US 9,958,808 B2
(45) Date of Patent: May 1, 2018

(54) IMAGE FORMING APPARATUS AND CONTAINER HAVING WALL MEMBER TO COVER DISCHARGE CHANNEL

(71) Applicant: FUJI XEROX Co., Ltd., Minato-ku, Tokyo (JP)

(72) Inventors: Kiyohito Horii, Kanagawa (JP); Seigo Shinozaki, Kanagawa (JP); Atsushi Funada, Kanagawa (JP); Hideki Kuge, Kanagawa (JP); Makoto Kanno, Kanagawa (JP); Shinichiro Fujimori, Kanagawa (JP); Daisuke Nakai, Kanagawa (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days. days.

(21) Appl. No.: 14/853,290

(22) Filed: Sep. 14, 2015

(65) Prior Publication Data

US 2016/0274493 A1 Sep. 22, 2016

(30) Foreign Application Priority Data

Mar. 18, 2015 (JP) ..... 2015-054189

(51) Int. Cl.
*G03G 15/22* (2006.01)
*G03G 15/08* (2006.01)

(52) U.S. Cl.
CPC ..... *G03G 15/0872* (2013.01); *G03G 15/0877* (2013.01); *G03G 15/0886* (2013.01)

(58) Field of Classification Search
CPC ..... G03G 15/0865; G03G 15/0812; G03G 15/0867; G03G 15/0834; G03G 15/0836; G03G 15/0872; G03G 15/0877
USPC ..... 399/262
See application file for complete search history.

(56) References Cited

U.S. PATENT DOCUMENTS

| | | | | |
|---|---|---|---|---|
| 5,765,079 | A * | 6/1998 | Yoshiki | G03G 15/0868 222/167 |
| 8,155,568 | B2 * | 4/2012 | Naito | G03G 15/087 399/262 |
| 8,824,934 | B2 * | 9/2014 | Hayashi | G03G 15/0872 399/258 |
| 2006/0133856 | A1 * | 6/2006 | Deguchi | G03G 15/0886 399/262 |
| 2007/0092302 | A1 * | 4/2007 | Koyama | G03G 15/0868 399/258 |
| 2007/0160393 | A1 * | 7/2007 | Taguchi | G03G 15/0855 399/258 |

(Continued)

FOREIGN PATENT DOCUMENTS

| | | |
|---|---|---|
| JP | 5037232 B2 | 9/2012 |
| JP | 5365110 B2 | 12/2013 |
| JP | 5407557 B2 | 2/2014 |

*Primary Examiner* — Walter L Lindsay, Jr.
*Assistant Examiner* — Arlene Heredia Ocasio
(74) *Attorney, Agent, or Firm* — Sughrue Mion, PLLC

(57) ABSTRACT

A container for powder detachably mountable to an image forming apparatus body includes a discharge channel and a wall member. The discharge channel has an upper end. Powder is discharged through the discharge channel. The wall member is disposed such that a gap is formed between the wall member and the upper end of the discharge channel. A transport part that transports the powder toward the discharge channel is provided in the container.

10 Claims, 15 Drawing Sheets

(56) References Cited

U.S. PATENT DOCUMENTS

| | | | | |
|---|---|---|---|---|
| 2008/0080904 | A1* | 4/2008 | Murayama | G03G 15/0855 399/262 |
| 2010/0189470 | A1* | 7/2010 | Yoshizawa | G03G 15/0898 399/262 |
| 2010/0226690 | A1* | 9/2010 | Kadota | G03G 15/0867 399/262 |
| 2011/0058857 | A1* | 3/2011 | Hori | G03G 15/0886 399/262 |
| 2012/0183333 | A1* | 7/2012 | Ohgoshi | G03G 15/087 399/258 |
| 2015/0338775 | A1* | 11/2015 | Hosokawa | G03G 15/0868 399/258 |
| 2016/0091825 | A1* | 3/2016 | Oba | G03G 15/0886 399/254 |

* cited by examiner

IMAGE FORMING APPARATUS AND CONTAINER HAVING WALL MEMBER TO COVER DISCHARGE CHANNEL

CROSS-REFERENCE TO RELATED APPLICATIONS

This application is based on and claims priority under 35 USC 119 from Japanese Patent Application No. 2015-054189 filed Mar. 18, 2015.

BACKGROUND

Technical Field

The present invention relates to an image forming apparatus and a container for powder.

Summary

According to an aspect of the present invention, a container for powder detachably mountable to an image forming apparatus body includes a discharge channel and a wall member. The discharge channel has an upper end. Powder is discharged through the discharge channel. The wall member is disposed such that a gap is formed between the wall member and the upper end of the discharge channel. A transport part that transports the powder toward the discharge channel is provided in the container.

BRIEF DESCRIPTION OF THE DRAWINGS

Exemplary embodiments of the present invention will be described in detail based on the following figures, wherein.

DETAILED DESCRIPTION

Figure 1:
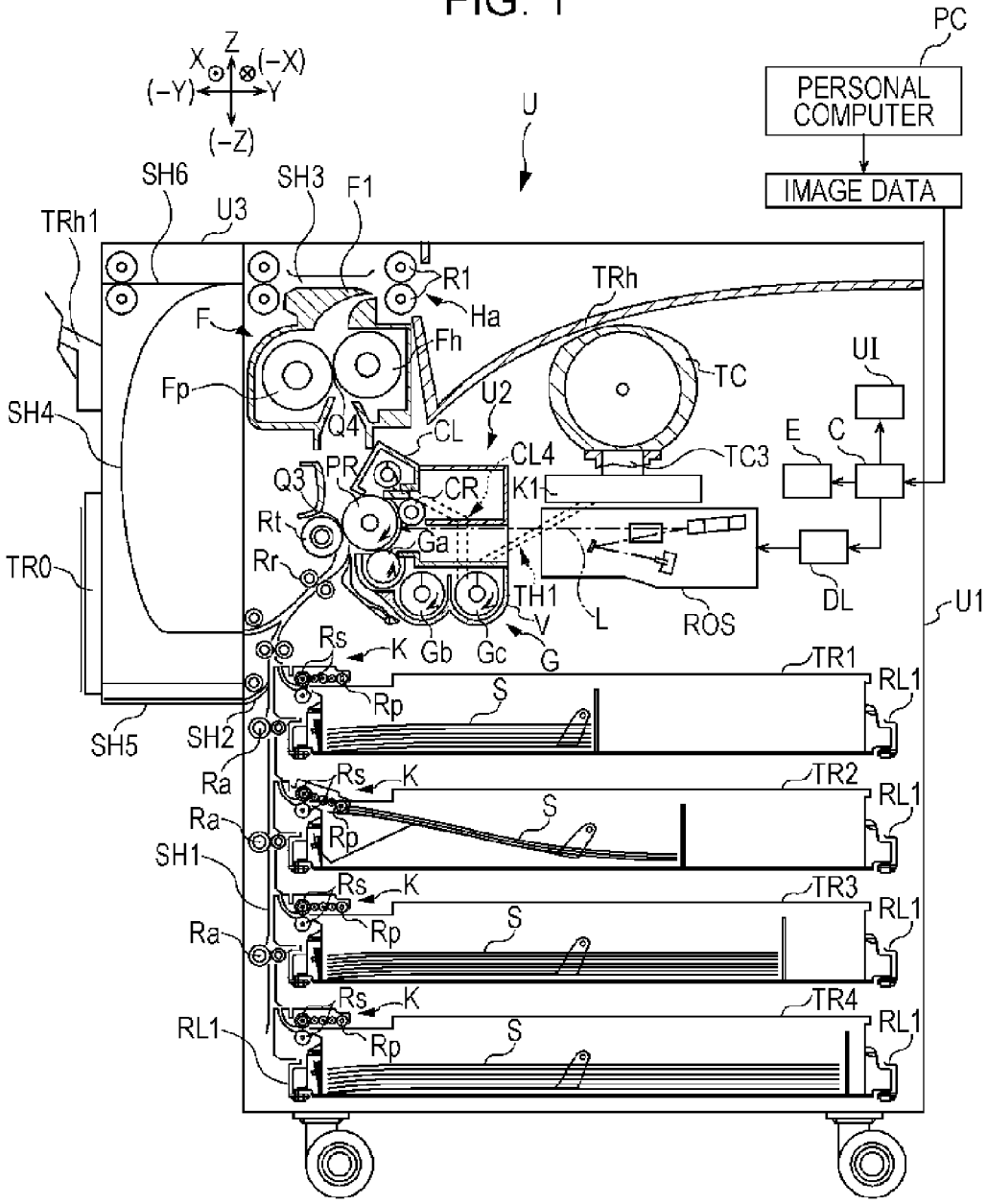
FIG. 1 is an overall explanatory view of an image forming apparatus according to a first exemplary embodiment.

Next, specific examples of exemplary embodiments of the present invention (referred to as exemplary embodiments hereafter) will be described with reference to the drawings. It is to be understood that the present invention is not limited to the following exemplary embodiments.

For ease of understanding of the description hereafter, the front-rear direction, the left-right direction, and the vertical direction in the drawings are respectively defined as the X direction, the Y direction, and the Z direction. Directions or sides indicated by arrows X, −X, Y, −Y, Z, and −Z respectively indicate the front, rear, right, left, upper, and lower directions or sides.

Also, circles marked with dots therein and circles marked with "x"s therein illustrated in the pages of the drawings respectively indicate arrows extending from the back side to the front side of the pages and arrows extending from the front side to the back side of the pages.

It is noted that, in the following description with reference to the drawings, elements other than those required for the description may be omitted from the drawings as appropriate for ease of understanding.

First Exemplary Embodiment

FIG. 1 is an overall explanatory view of an image forming apparatus according to a first exemplary embodiment.

In FIG. 1, a printer U that serves as an example of the image forming apparatus according to the first exemplary embodiment includes a printer body U1 that serves as an example of an image forming apparatus body. A first output tray TRh that serves as an example of a first medium output unit is provided in an upper surface of the printer body U1. An operation unit UI is provided in the upper surface of a right portion of the printer body U1. The operation unit UI includes components such as a display (not illustrated). The operation unit UI allows a user to perform an input operation therewith.

A host computer is illustrated as an example of an image information transmitting device for the printer U according to the first exemplary embodiment, and specifically, a personal computer is electrically connected to the printer U.

The printer U includes a controller C that serves as an example of a controller. The controller C is capable of receiving electrical signals such as image information and a control signal transmitted from the personal computer PC. The controller C is also capable of outputting control signals to the operation unit UI and a power source circuit E. Furthermore, the controller C is electrically connected to a writing circuit DL.

The writing circuit DL outputs a driving signal to a light exposure device ROS in accordance with information input thereto. The light exposure device ROS serves as an example of a writing device. The light exposure device ROS is capable of outputting a laser beam L in accordance with a signal input thereto. The laser beam L serves as an example of writing light.

Figure 2:
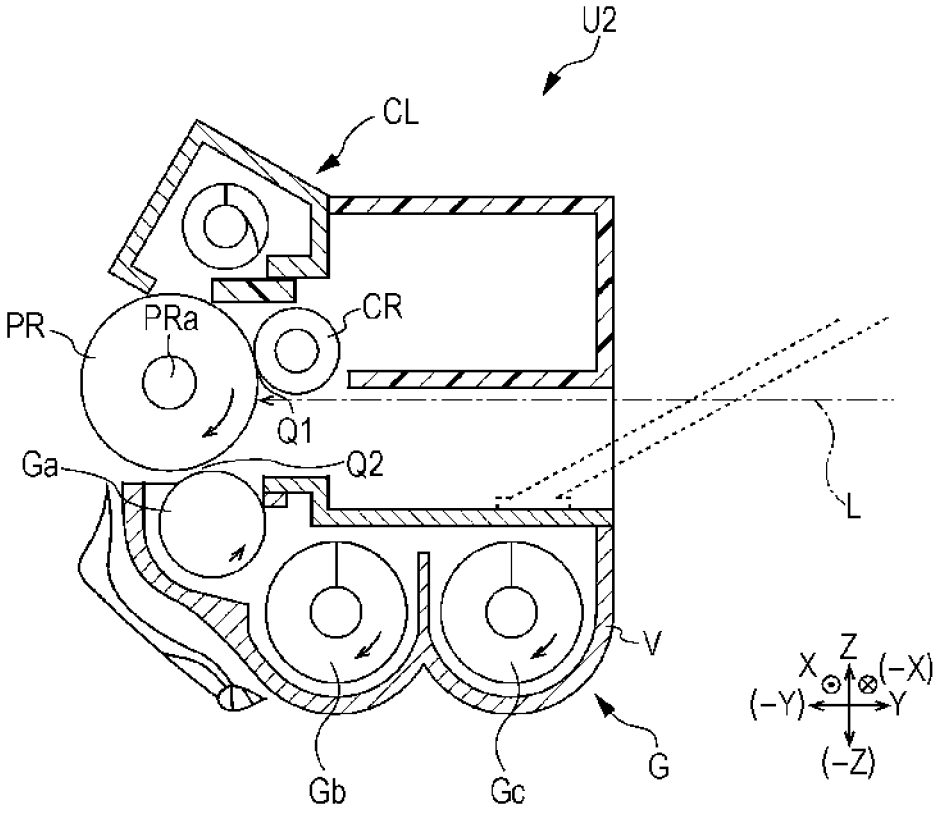
FIG. 2 is an enlarged view of part of a toner image forming device illustrated in FIG. 1.

FIG. 2 is an enlarged view of part of a toner image forming device illustrated in FIG. 1.

Referring to FIGS. 1 and 2, a photosensitive body PR that serves as an example of an image holding body is disposed to the left of the light exposure device ROS. The photosensitive body PR according to the first exemplary embodiment is supported such that the photosensitive body PR is rotatable about a rotational shaft PRa in an arrow direction. The photosensitive body PR has a writing region Q1 that is irradiated with the laser beam L.

A charging roller CR, a developing device G, and a photosensitive-body cleaner CL are arranged in a rotational direction of the photosensitive body PR around the photosensitive body PR. The charging roller CR serves as an example of a charging member. The photosensitive-body cleaner CL serves as an example of a cleaning device for the image holding body.

In the printer U according to the first exemplary embodiment, the photosensitive body PR, the charging roller CR, the developing device G, and the photosensitive-body cleaner CL are integrated with one another to form a unit that is detachably attached. That is, the photosensitive body PR, the charging roller CR, the developing device G, and the photosensitive-body cleaner CL are included in a process unit U2 that is detachably attached to the printer body U1.

A charging voltage is applied from the power source circuit E to the charging roller CR.

The developing device G includes a developing container V therein. The developing container V contains toner that serves as an example of developer, which is an example of powder. A developing roller Ga that serves as an example of a developer holding body is rotatably supported in the developing container V. The developing roller Ga faces the photosensitive body PR in a developing region Q2.

Furthermore, a developing voltage is applied from the power source circuit E to the developing roller Ga. Augers Gb and Gc are rotatably supported in the developing container V. The augers Gb and Gc each serve as an example of a developer transport member.

The toner image forming device that forms a toner image on the photosensitive body PR includes the components such as the photosensitive body PR, the charging roller CR, the light exposure device ROS, and the developing device G.

One end of a replenishing path of a toner replenishing device TH1 is connected to the developing container V. The toner replenishing device TH1 that serves as an example of a developer replenishing device is secured to and supported by the printer U. The other end of the replenishing path of the toner replenishing device TH1 is connected to a toner cartridge TC that serves as an example of a container for powder.

The toner cartridge TC is detachable from and mountable to the printer U by removing and inserting in the front-rear direction.

Referring to FIG. 1, plural sheet feed trays TR1 to TR4 are provided in a lower portion of the printer U. The plural sheet feed trays TR1 to TR4 each serve as an example of a medium containing unit. The plural sheet feed trays TR1 to TR4 contain recording sheets S. Each of the sheets S serves as an example of a medium.

In FIG. 1, rails RL1 are disposed on the left and right sides of each of the sheet feed trays TR1 to TR4. The rails RL1 each serve as an example of a container guide member. Left and right end portions of the sheet feed trays TR1 to TR4 are movably supported by the rails RL1. Thus, each of the sheet feed trays TR1 to TR4 is supported by a corresponding pair of the left and right rails RL1 such that each of the sheet feed trays TR1 to TR4 is capable of being drawn and retracted in the front-rear direction.

Referring to FIG. 1, a sheet feed device K is disposed to the upper left of each of the sheet feed trays TR1 to TR4. The sheet feed devices K each include a pickup roller Rp that serves as an example of a medium pickup member. A separation roller set Rs that serves as an example of a separation member is disposed to the left of the pickup roller Rp. The separation roller set Rs includes a feed roller and a retard roller. The feed roller serves as an example of a medium transport member. The retard roller serves as an example of medium parting member.

A sheet feed path SH1 that serves as an example of a medium transport path is disposed to the left of the sheet feed devices K. The sheet feed path SH1 extends upward. Plural transport rollers Ra are disposed along the sheet feed path SH1. Each of the transport rollers serves as an example of a medium transport member. A registration roller Rr that serves as an example of a medium transport timing adjustment member is disposed at an upper end of the sheet feed path SH1, which is a downstream end of the sheet feed path SH1.

Furthermore, a manual feed tray TR0 that serves as an example of a manual feed unit is attached on a left side portion of the printer U. A left end of a manual feed path SH2 that serves as an example of a manual feed transport path is connected to a right portion of the manual feed tray TR0. A right end of the manual feed path SH2 is connected to the sheet feed path SH1.

Referring to FIG. 1, a transfer roller Rt that serves as an example of a transfer device is disposed above the registration roller Rr. The transfer roller Rt faces and is in contact with the photosensitive body PR in a transfer region Q3. Thus, the transfer roller Rt according to the first exemplary embodiment is rotated by rotation of the photosensitive body PR. A transfer voltage is applied from the power source circuit E to the transfer roller Rt.

The photosensitive-body cleaner CL is disposed on the downstream side of the transfer roller Rt in the rotational direction of the photosensitive body PR. A collection path CL4 that serves as an example of a developer transport path is supported by the photosensitive-body cleaner CL. The collection path CL4 extends from the photosensitive-body cleaner CL to the developing device G.

Referring to FIG. 1, a fixing device F is supported above the transfer roller Rt. The fixing device F includes a heating roller Fh and a pressure roller Fp. The heating roller Fh serves as an example of a heat fixing member. The pressure roller Fp serves as an example of a pressure fixing member. The heating roller Fh and the pressure roller Fp are in contact with each other in a fixing region Q4. A drive is transmitted from a drive source (not illustrated) to the heating roller Fh, thereby rotating the heating roller Fh. Also, power used to heat a heater (not illustrated) is supplied from the power source circuit E to the heating roller Fh.

An image recording section U2+Rt+F that records an image on the sheet S includes the process unit U2 that serves as an example of the toner image forming device, the transfer roller Rt, and the fixing device F.

A sheet guide F1 that serves as an example of a medium guide unit is formed on the upper portion of the fixing device F. Sheet output rollers R1 are disposed to the right of the sheet guide F1. The sheet output rollers R1 each serve as an example of a medium output member. A medium output opening Ha is formed to the right of the sheet output rollers R1. The first output tray TRh is disposed below the medium output opening Ha.

Referring to FIG. 1, a connection path SH3 that serves as an example of a medium transport path is disposed at a position above the fixing device F and to the left of the sheet output rollers R1. The connection path SH3 extends leftward from the medium output opening Ha.

An inversion unit U3 that serves as an example of a medium inversion device is supported above the manual feed tray TR0 on the left side surface of the printer body U1. An inversion path SH4 that serves as an example of a medium transport path is formed in the inversion unit U3. An upper end of the inversion path SH4 is connected to a left end of the connection path SH3. A lower end of the inversion path SH4 is merged with the sheet feed path SH1 on the upstream of the registration roller Rr.

Furthermore, a second output path SH6 that serves as an example of a medium transport path is formed in an upper portion of the inversion unit U3. A right end of the second output path SH6 is connected to the connection path SH3. The second output path SH6 branches from the inversion path SH4. A left end of the second output path SH6 extends to a left side surface of the inversion unit U3. A face up tray TRh1 that serves as an example of a second output unit is supported on the left side surface of the inversion unit U3. Thus, the sheet S having passed through the second output path SH6 is able to be output to the face up tray TRh1.

Functions of the Image Forming Apparatus

Image information transmitted from the personal computer PC is input to the controller C of the printer U according to the first exemplary embodiment having the above-described structure. The controller C converts the image information input thereto into latent image forming information at preset timing and outputs the latent image forming information to the writing circuit DL. The light exposure device ROS outputs the laser beam L in accordance with a signal received by the writing circuit DL. The controller C controls operations of the operation unit UI, the writing circuit DL, the power source circuit E, and so forth.

Referring to FIGS. 1 and 2, a surface of the photosensitive body PR is charged by the charging roller CR to which the charging voltage is applied. The surface of the photosensitive body PR charged by the charging roller CR is irradiated with and scanned by the laser beam L from the light exposure device ROS in the writing region Q1, thereby an electrostatic latent image is formed. The surface of the photosensitive body PR on which the electrostatic latent image has been formed sequentially passes through the developing region Q2 and the transfer region Q3.

The developing roller Ga faces the photosensitive body PR in the developing region Q2. The developing roller Ga is rotated while holding developer in the developing container V on the surface of the developing roller Ga. Thus, the electrostatic latent image on the surface of the photosensitive body PR is developed into a toner image by the toner held on the surface of the developing roller Ga. The toner image serves as an example of a visual image. The developer in the developing container V is circulated while being agitated by the augers Gb and Gc.

As the development is performed with the developing roller Ga, the developer in the developing container V is consumed. As the developer in the developing container V is consumed, the developing container V is replenished with the developer from the toner cartridge TC. That is, in accordance with the amount of consumed developer, the toner in the toner cartridge TC is transported to the discharge port TC3. The toner discharged through the discharge port TC3 is transported to the developing container V by a replenishing transport member (not illustrated) in the replenishing path of the toner replenishing device TH1.

The sheets S on which images are to be recorded are contained in the sheet feed trays TR1 to TR4. The sheets S contained in the sheet feed trays TR1 to TR4 are picked up by the pickup rollers Rp of the sheet feed devices K. The separation roller sets Rs each separate one sheet after another from the sheets S having been picked up by a corresponding one of the pickup rollers Rp. Each of the sheets S having been separated by the separation roller sets Rs is fed into the sheet feed path SH1. The sheet S is transported toward the registration roller Rr by the transport rollers Ra through the sheet feed path SH1.

The sheet S fed from the manual feed tray TR0 is transported to the registration roller Rr through the manual feed path SH2. The sheet S having been transported to the registration roller Rr is transported to the transfer region Q3 by the registration roller Rr at timing adjusted to timing at which the toner image on the surface of the photosensitive body PR is moved to the transfer region Q3.

In the transfer region Q3, the toner image on the surface of the photosensitive body PR is transferred onto the sheet S that is passing through the transfer region Q3 by the transfer roller Rt to which the transfer voltage is applied.

Referring to FIG. 2, the toner attracted to the surface of the photosensitive body PR having passed through the transfer region Q3 is removed by the photosensitive-body cleaner CL. Thus, the photosensitive body PR is cleaned. The toner removed by the photosensitive-body cleaner CL is returned into the developing container V through the collection path CL4. That is, the developer collected by the photosensitive-body cleaner CL is reused by the developing device G.

After the surface of the photosensitive body PR has been cleaned by the photosensitive-body cleaner CL, the photosensitive body PR is charged again by the charging roller CR.

The sheet S onto which the toner image has been transferred in the transfer region Q3 is transported to the fixing region Q4 of the fixing device F. At this time, the toner image on the sheet S has not been fixed.

The sheet S is interposed between the heating roller Fh and the pressure roller Fp in the fixing region Q4, so that the toner image is heat fixed.

The sheet S onto which the toner image has been fixed by the fixing device F is guided by the sheet guide F1 so as to be transported to the sheet output rollers R1. In the case where the sheet S is output to the first output tray TRh, the sheet S having been fed to the sheet output rollers R1 is output to the first output tray TRh through the medium output opening Ha.

In the case where duplex printing is performed, the sheet output rollers R1 are rotated in the reverse direction when a trailing end in a transport direction of the sheet S has passed through the sheet guide F1. At this time, the image has been recorded on a first side of this sheet S. Thus, the sheet S is transported into the inversion path SH4 through the connection path SH3. The sheet S having been transported through the inversion path SH4 is transported in the inverted state to the registration roller Rr. Thus, the sheet S is transported from the registration roller Rr to the transfer region Q3 again, and an image is recorded on a second side of the sheet S.

When the sheet S is output to the face up tray TRh1, the sheet S transported through the connection path SH3 by the reverse rotation of the sheet output rollers R1 is transported into the second output path SH6. The sheet S having been transported through the second output path SH6 is output to the face up tray TRh1.

Description of the Toner Cartridge

Figure 3:
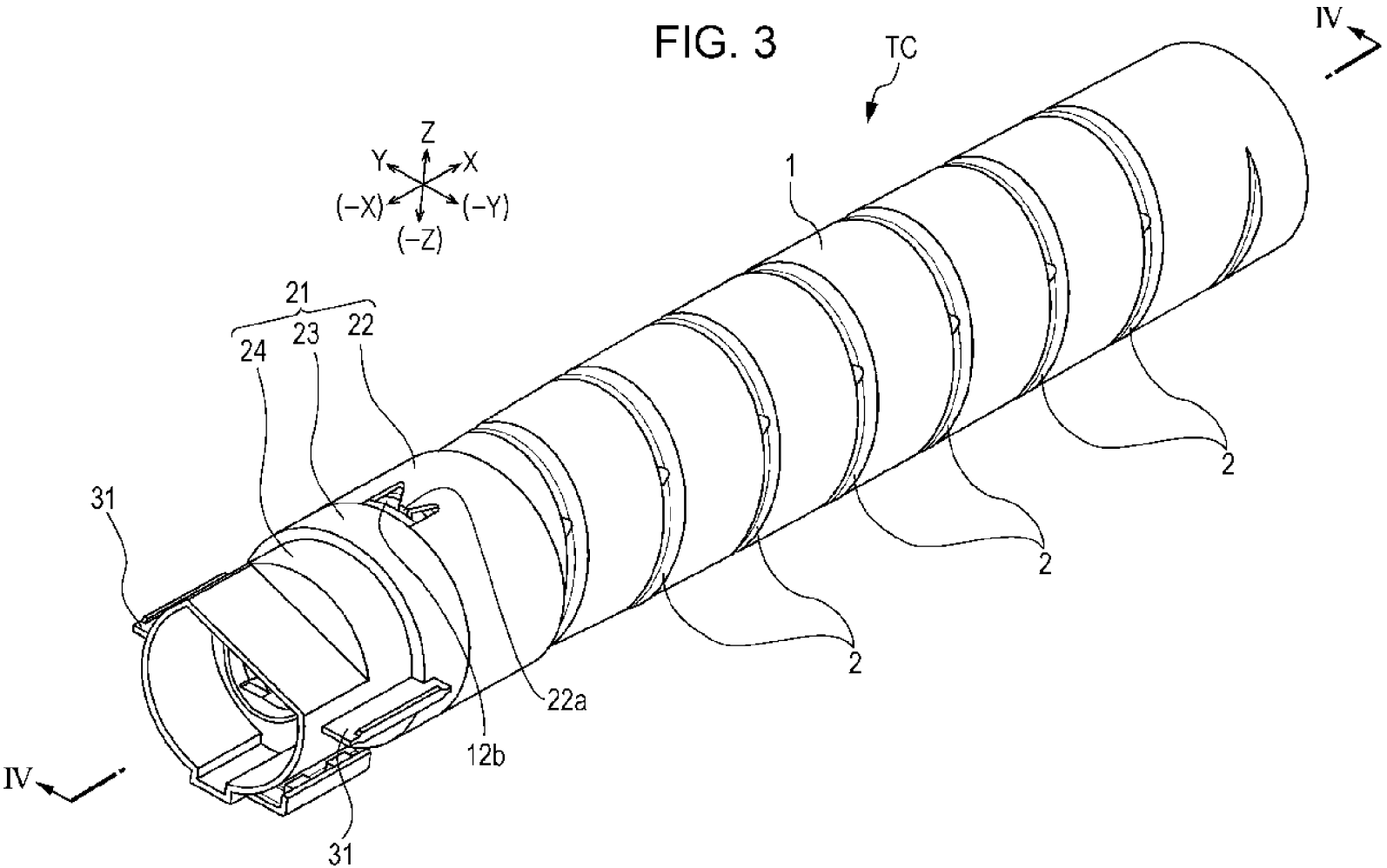
FIG. 3 is a perspective view of a toner cartridge according to a first exemplary embodiment.

FIG. 3 is a perspective view of the toner cartridge according to the first exemplary embodiment.

Figure 4:
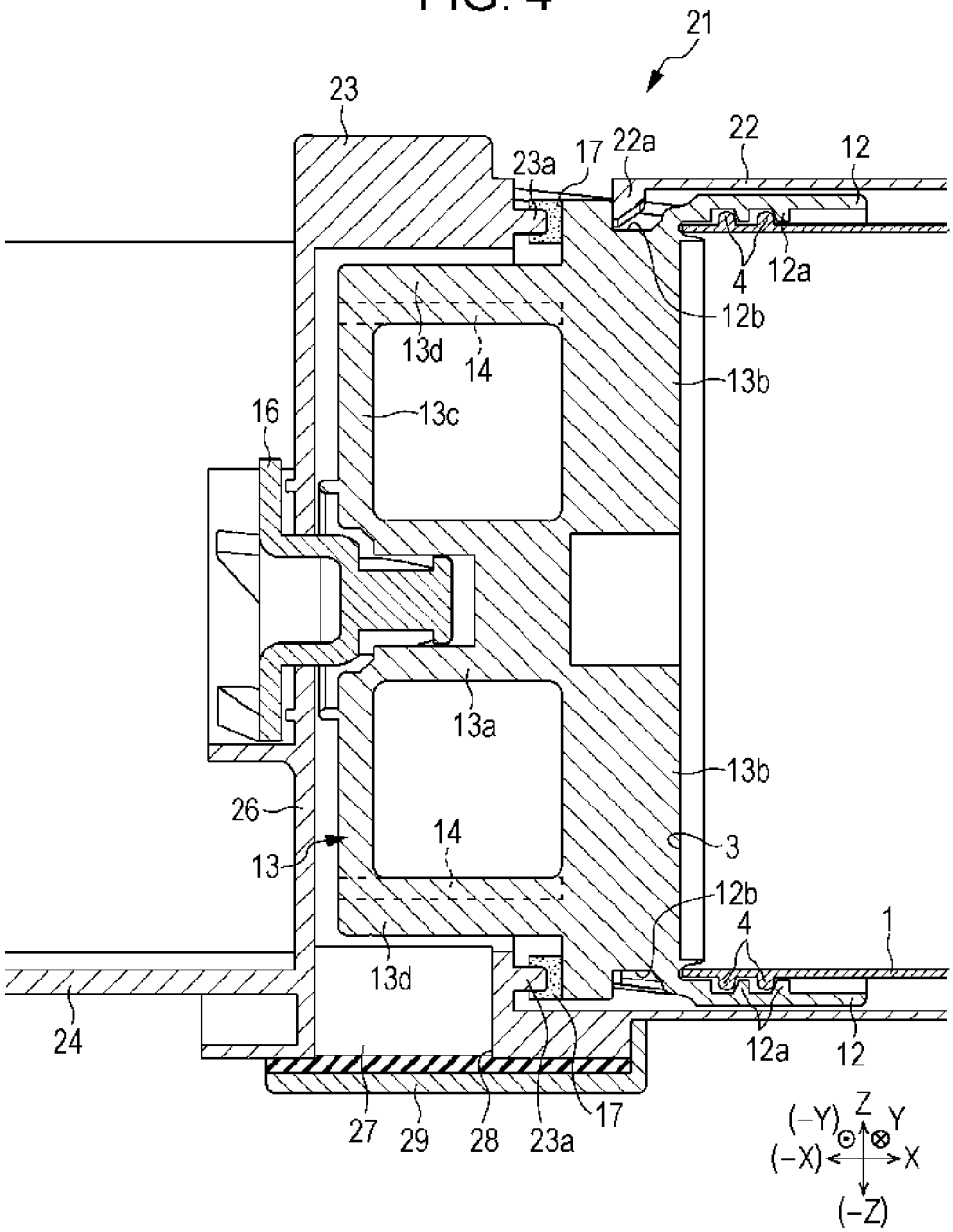
FIG. 4 is a sectional view of the toner cartridge illustrated in FIG. 3 taken along line IV-IV illustrated in FIG. 3.

FIG. 4 is a sectional view of the toner cartridge illustrated in FIG. 3 taken along line IV-IV illustrated in FIG. 3.

Referring to FIGS. 3 and 4, the toner cartridge TC according to the first exemplary embodiment includes a bottle 1 that serves as an example of a container body. The bottle 1 has a cylindrical shape extending in the front-rear direction and is capable of containing the developer therein. The bottle 1 has a helical groove portion 2 that serves as an example of a transport part in its wall surface. Referring to FIGS. 3 and 4, the bottle 1 has an opening 3 at its rear end. A screw portion 4 that serves as an example of a fastening portion is formed on the front side of the opening 3 in an outer surface of the bottle 1.

Figure 5:
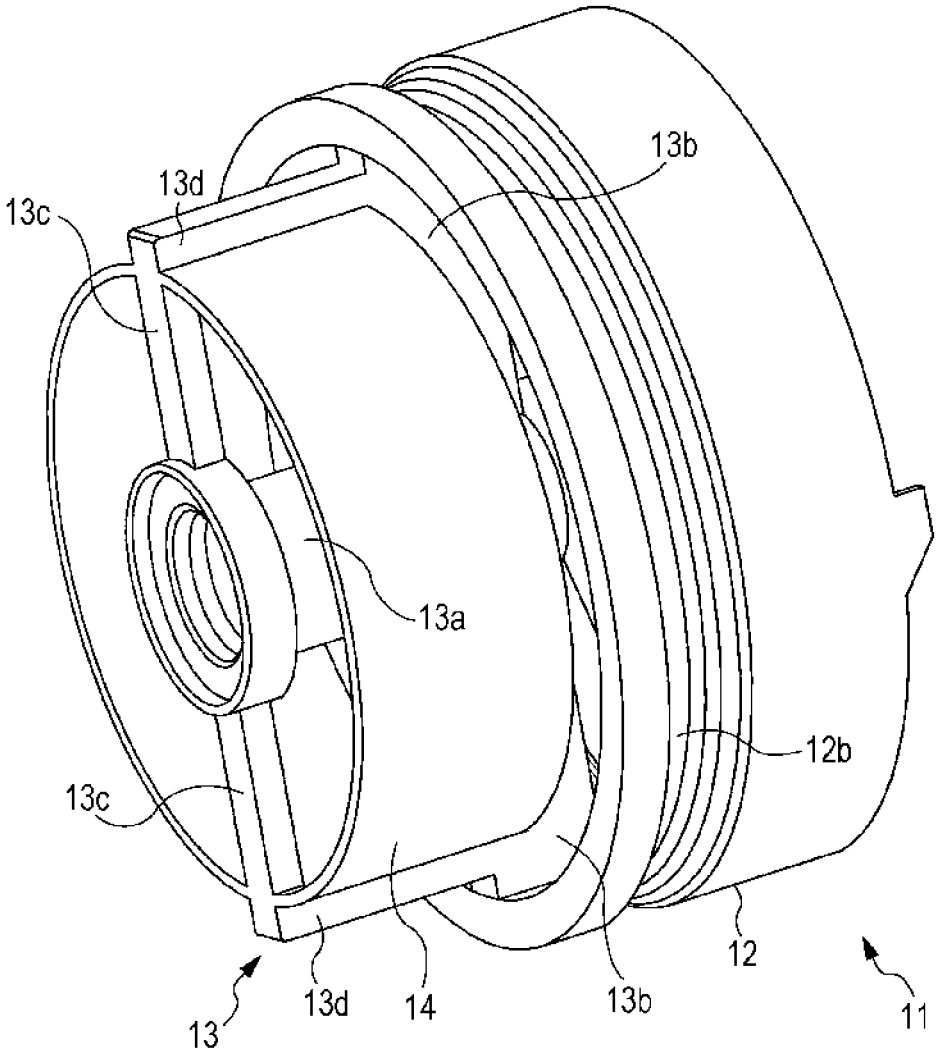
FIG. 5 is an explanatory view of a fin member according to a first exemplary embodiment.

FIG. 5 is an explanatory view of a fin member according to the first exemplary embodiment.

Referring to FIGS. 3 to 5, a fin member 11 that serves as an example of a crumbling member is disposed behind the bottle 1. The fin member 11 includes a cylindrical portion 12 on the front side and a fin body 13 on the rear side. The cylindrical portion 12 has a screw portion 12*a* that serves as an example of a fastening portion in its inner circumferential surface. The screw portion 12*a* corresponds to the screw portion 4. Accordingly, the screw portion 12*a* and the screw portion 4 are engaged with each other, thereby fastening the fin member 11 and the bottle 1 to each other. Thus, a rotating body 1+11 of the first exemplary embodiment is formed of the fin member 11 and the bottle 1.

Furthermore, a ring-shaped recess 12*b* is formed at a rear portion of an outer circumference of the cylindrical portion 12.

The fin body 13 includes a shaft portion 13*a* that extends in the front-rear direction. Support arms 13*b* that extend outward in the radial directions are formed at a front end of the shaft portion 13*a*. The support arms 13*b* each serve as an example of a crumbling part and each also serve as an example of a portion to be supported. Outer ends of the support arms 13*b* are connected to the inner circumferential surface of the cylindrical portion 12.

First crumbling parts 13*c* that extend outward in the radial directions are formed on a rear portion of the shaft portion 13*a*. Second crumbling parts 13*d* that extend in the front-rear direction are formed between outer ends of the first crumbling parts 13*c* in the radial directions and the support arms 13*b*.

A cylindrical wall member 14 is integrally formed with the second crumbling parts 13*d* on the shaft portion 13*a* side of the second crumbling parts 13*d*. Referring to FIG. 4, a gap is formed between an upper end of a discharge channel 27, which will be described later, and the wall member 14 according to the first exemplary embodiment. The size of the gap is set to 5 mm according to the first exemplary embodiment. However, the size of the gap may be arbitrarily changed in accordance with the design and use, for example, the amount of the developer wished to be transported per unit time.

A coupling 16 that serves as an example of a drive receiving member is supported at a rear end of the shaft portion 13*a*. When the toner cartridge TC is mounted to the printer body U1, the coupling 16 is engaged with a coupling supported by the printer body U1, thereby receiving drive.

Referring to FIGS. 4 and 5, a toner seal 17 that serves as an example of an anti-leakage member is supported at a rear end surface of the cylindrical portion 12. The toner seal 17 has an annular shape, that is, a so-called ring shape formed along the rear end surface of the cylindrical portion 12. The toner seal 17 is formed of any material capable of suppressing leakage of the developer. For example, the toner seal 17 may be formed of a foamed member such as a sponge.

A flange member 21 that serves as an example of a discharge member is supported around the fin member 11. The flange member 21 has a cylindrical shape. The flange member 21 includes a middle diameter portion 22 disposed at the front thereof, a large diameter portion 23 disposed at the center thereof in the front-rear direction, and a small diameter portion 24 disposed at the rear thereof.

The middle diameter portion 22 has an inner diameter that is sufficient to cover a rear portion of an outer circumference of the rotating body 1+11. The middle diameter portion 22 has a claw portion 22*a* that serves as an example of a connecting portion. The claw portion 22*a* is disposed at a position corresponding to the ring-shaped recess 12*b* and extends inward in the radial direction. The claw portion 22*a* is in contact with the recess 12*b* so as to regulate a forward movement of the rotating body 1+11 relative to the flange member 21. That is, the claw portion 22*a* connects the rotating body 1+11 and the flange member 21 to each other.

A ring-shaped projection 23*a* that serves as an example of a compressing portion is formed at a front end of the large diameter portion 23. Thus, when the flange member 21 and the rotating body 1+11 are connected to each other, the projection 23*a* is supported such that the projection 23*a* is pressed against the toner seal 17 so as to compress the toner seal 17.

A plate-shaped wall portion 26 that extends in the up-down direction and the left-right direction is formed at a boundary between the large diameter portion 23 and the small diameter portion 24. The coupling 16 that penetrates through the wall portion 26 is rotatably supported by the wall portion 26.

The discharge channel 27 that extends downward is formed on the lower side of the wall portion 26. A discharge port 28 that serves as an example of an outlet port is formed at a lower end of the discharge channel 27.

A shutter 29 that serves as an example of an opening and closing member is supported below the discharge channel 27 so as to be movable in the front-rear direction. The shutter 29 moves between an open position and a closed position. The shutter 29 opens the discharge port 28 at the open position and closes the discharge port 28 at the closed position as the toner cartridge TC is inserted and removed. Various known related-art structures may be adopted for the structure for moving the shutter 29 as the toner cartridge TC is inserted and removed. Thus, the detailed description of the structure for moving the shutter 29 is omitted.

Referring to FIG. 3, insertion guides 31 that each serve as an example of a portion to be guided are formed on an outer circumferential surface of the small diameter portion 24. The insertion guides 31 are guided by guiding portions (not illustrated) provided in the printer body U1 that serves as the example of the image forming apparatus body when mounting the toner cartridge TC.

Operation of the First Exemplary Embodiment

In the printer U according to the first exemplary embodiment having the above-described structure, in a state in which the toner cartridge TC has been mounted to the printer body U1, the fin member 11 and the bottle 1 are rotated when the drive is transmitted to the coupling 16 in accordance with consumption of the toner. When the bottle 1 is rotated, the developer is transported rearward along the helical groove portion 2. Thus, a rotating transport member is not necessarily required in the bottle of the toner cartridge TC according to the first exemplary embodiment, and accordingly, the manufacturing cost of the toner cartridge TC may be reduced.

The toner replenishing device TH1 is replenished with the developer transported rearward along with rotation of the bottle 1 through the discharge port 28. When the bottle 1 is rotated, the fin body 13 is also rotated. Thus, the toner closely accumulated and clumped near the discharge port 28 is crumbled or loosened. Accordingly, compared to a structure without the fin body 13, the likelihood of the developer being clumped near the discharge port 28 and clogging of the discharge port 28 due to the developer is reduced.

Figure 6:
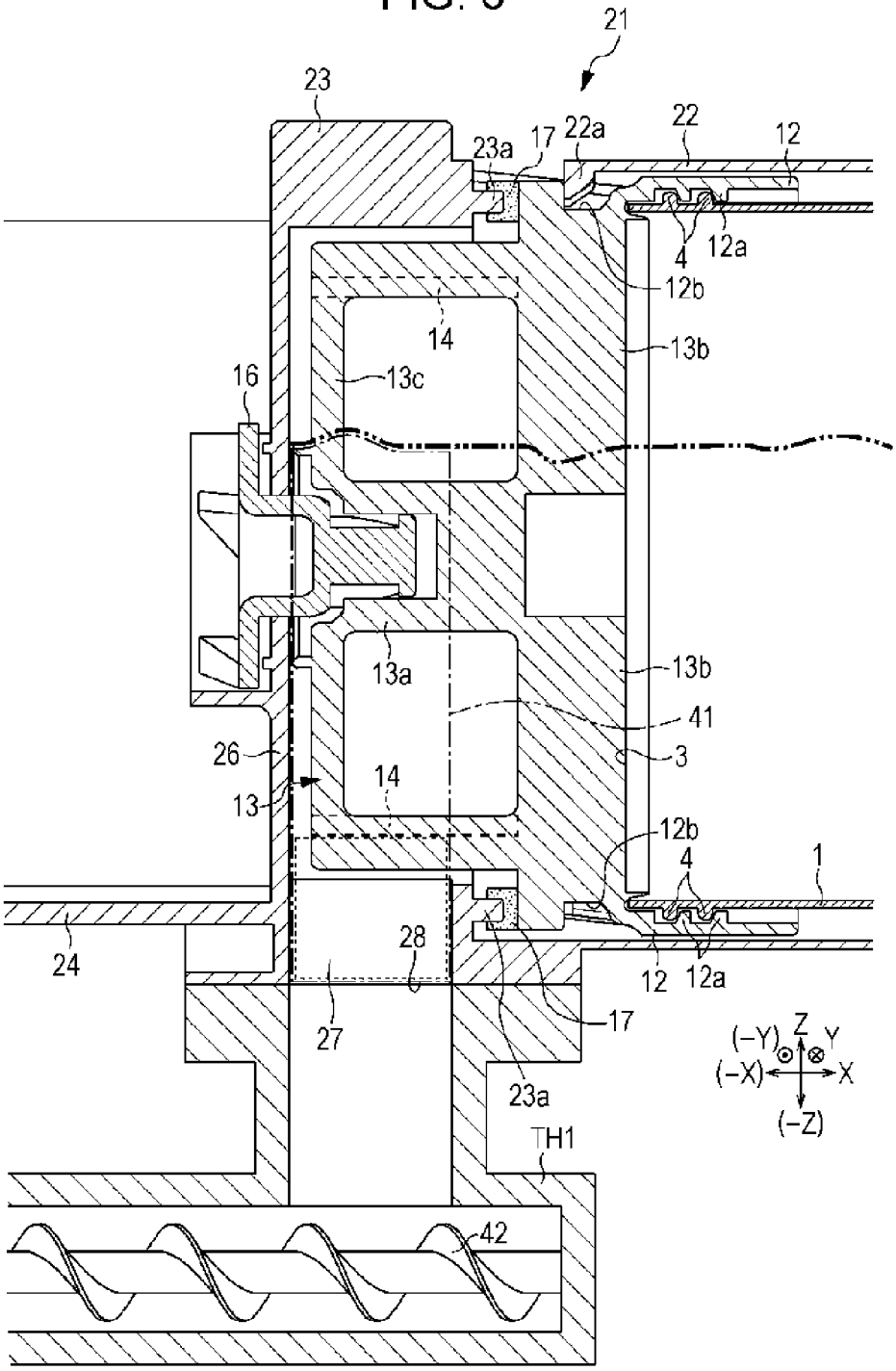
FIG. 6 is an explanatory view of operations according to the first exemplary embodiment.

FIG. 6 is an explanatory view of operations according to the first exemplary embodiment.

Referring to FIG. 6, the developer having been transported rearward by the bottle 1 is fed toward the discharge port 28 by gravity. At this time, assuming that the amount (level) of the developer indicated by a two-dot chain line is contained inside, developer 41 existing above the discharge port 28 tends to flow into the discharge port 28 as indicated by a one-dot chain line illustrated in FIG. 6 with the related-art structure that does not include the wall member 14. Thus, even when the rotation of the bottle 1 is stopped, a transport member 42 of the toner replenishing device TH1, to which the toner cartridge TC is connected, is driven, thereby the developer is transported. This causes the developer 41 above the discharge port 28 to flow due to gravity. Furthermore, in the case where a new toner cartridge TC is mounted, the developer 41 existing above the discharge port 28 tends to flow from the toner cartridge TC when the toner cartridge TC is mounted. Thus, with the related-art structure, a space between the toner replenishing device TH1 and the toner cartridge TC is likely to be filled with the developer. When the toner cartridge TC is removed or inserted in this state, the developer with which the discharge port 28 is filled is scraped off. Consequently, the developer may adhere to components around the discharge port 28, thereby contaminating the interior of the image forming apparatus or clothes, hands, or the like of an operator.

In contrast, an upper side of an entrance of the discharge channel 27 of the toner cartridge TC according to the first exemplary embodiment is covered by the wall member 14. Thus, the amount of the developer flowing into the discharge port 28 due to gravity is the amount of the developer existing between the discharge port 28 and the wall member 14 as indicated by a broken line illustrated in FIG. 6, and the developer on or above the wall member 14 is unable to flow into the discharge port 28. That is, the amount of the developer flowing into the discharge port 28 due to gravity is limited. Accordingly, a state in which the discharge channel 27 is filled with the developer is unlikely to be assumed when mounting the toner cartridge TC or when driving the transport member 42 with the rotation of the bottle 1 stopped. This reduces the occurrences of the scraping off of the developer at the discharge port 28 occurring while the toner cartridge TC is removed or inserted. Thus, contamination of the interior of the image forming apparatus or clothes, hands, or the like of the operator may be reduced.

Particularly in the toner cartridge TC according to the first exemplary embodiment, the developer moving toward the discharge port 28 passes through a gap between the wall member 14 and an inner circumferential surface of the large diameter portion 23. Thus, the amount of the developer fed to the discharge port 28 per unit time may be stabilized in accordance with the width of the gap. Accordingly, supply of the developer may be easily stabilized compared to the case where the developer 41 flows from above substantially without being regulated so as to be excessively supplied when mounting the toner cartridge TC.

Furthermore, the wall member 14 is provided in and integrally rotated with the fin member 11 in the toner cartridge TC according to the first exemplary embodiment. In the case where the wall member 14 is secured, the developer may stagnate due to adherence of the developer to the wall member 14 or due to clumping of the developer. In contrast, with the rotating wall member 14, adhesion of the developer may be reduced compared to the secured wall member.

Furthermore, the wall member 14 of the toner cartridge TC according to the first exemplary embodiment has a cylindrical shape, that is, is formed in a circumferential direction of rotation of the fin member 11. With some related-art techniques, the wall member is provided in only part of the circumferential direction. In such structures, positioning of the wall member may be required every time the wall member is stopped or there may be a problem that is cannot be addressed when the structure is touched by a human and moved. In contrast, positioning of the wall member 14 having a cylindrical shape is not necessarily required.

Second Exemplary Embodiment

Figure 7:
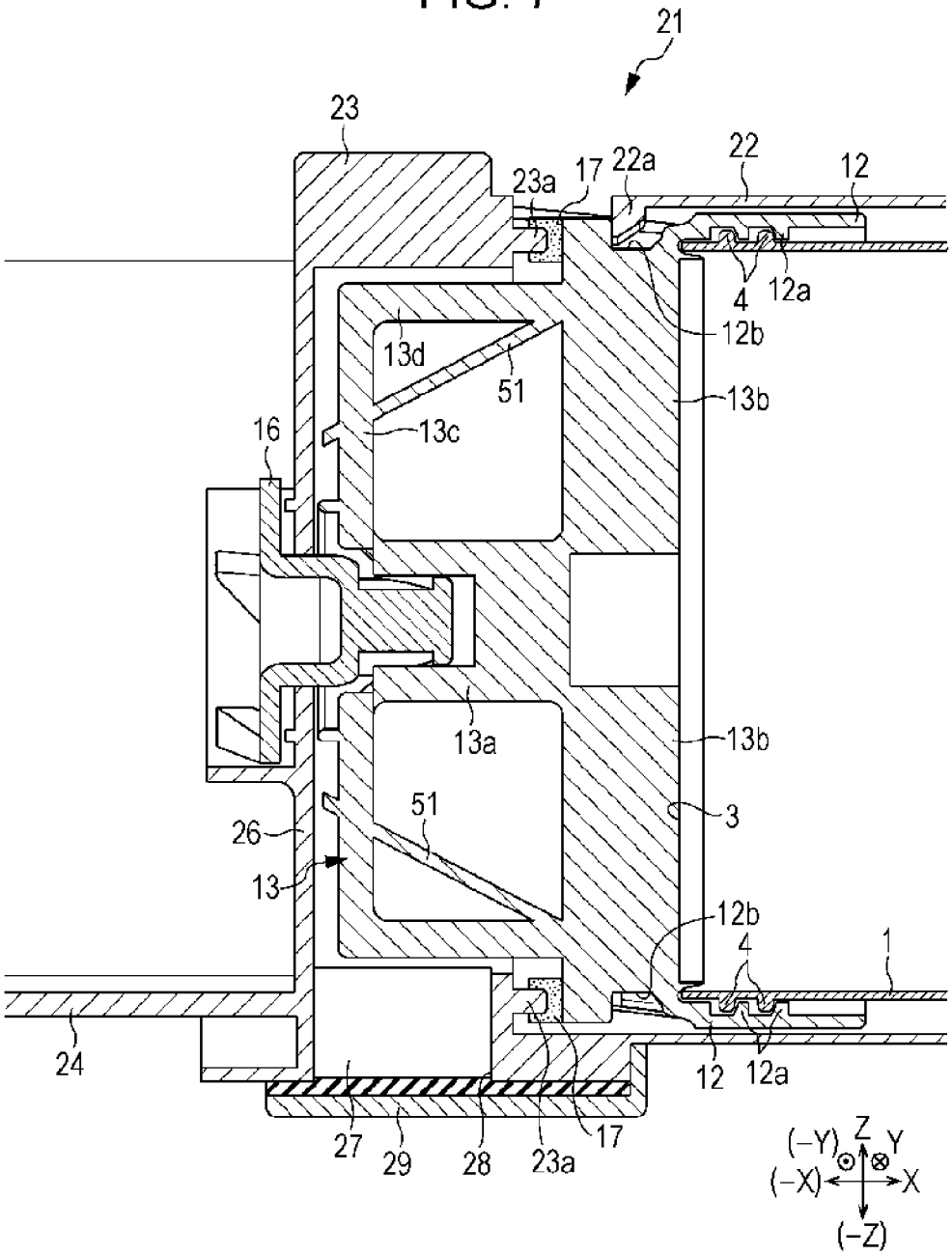
FIG. 7 is for explanation of a toner cartridge according to a second exemplary embodiment and corresponds to FIG. 4 of the first exemplary embodiment.

FIG. 7 is for explanation of the toner cartridge according to a second exemplary embodiment and corresponds to FIG. 4 of the first exemplary embodiment.

Figure 8:
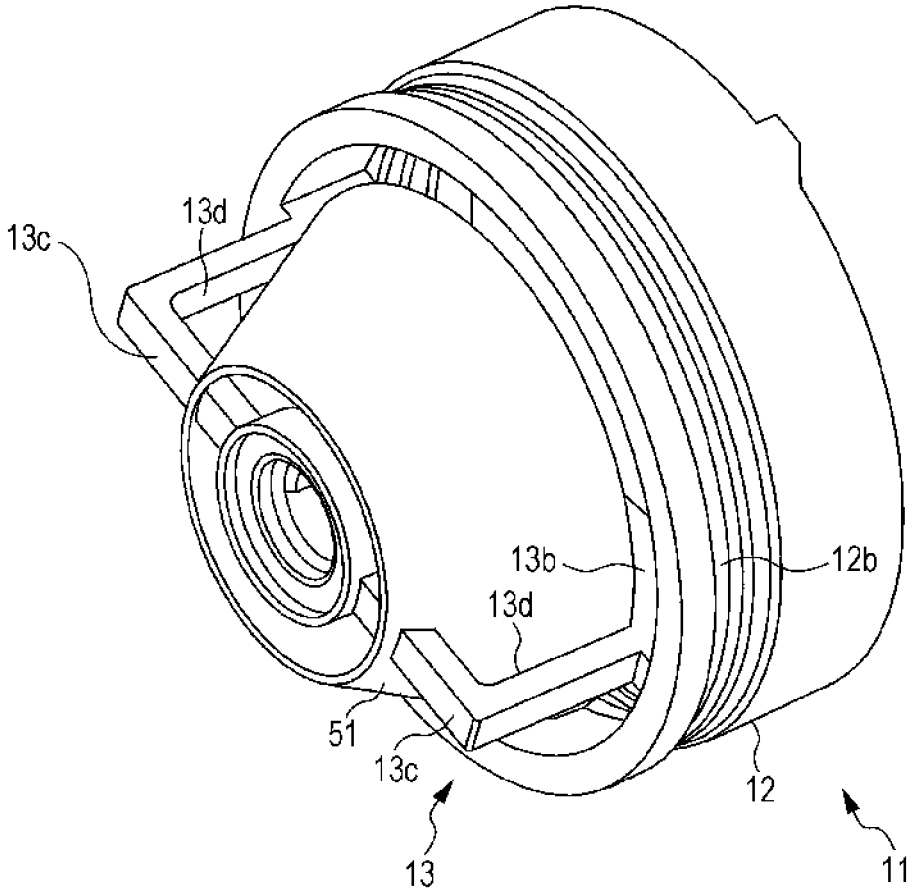
FIG. 8 is an explanatory view of a fin member according to the second exemplary embodiment and corresponds to FIG. 5 of the first exemplary embodiment.

FIG. 8 is an explanatory view of the fin member according to the second exemplary embodiment and corresponds to FIG. 5 of the first exemplary embodiment.

Next, the second exemplary embodiment of the present invention will be described. In this description of the second exemplary embodiment, elements corresponding to those of the first exemplary embodiment are denoted by the same reference signs and detailed description thereof is omitted.

Although the second exemplary embodiment is different from the first exemplary embodiment in the following points, the second exemplary embodiment has a structure that is the same as or similar to that of the first exemplary embodiment in other points.

Referring to FIGS. 7 and 8, the toner cartridge TC according to the second exemplary embodiment includes a conical wall member 51 instead of the cylindrical wall member 14 of the first exemplary embodiment. The diameter of the wall member 51 decreases toward the rear thereof.

With the printer U according to the second exemplary embodiment having the above-described structure, the amount of the developer flowing toward the discharge port 28 is limited more than with a structure not provided with the wall member 51. Accordingly, as is the case with the first exemplary embodiment, the contamination of the interior of the image forming apparatus and the like may be reduced with the toner cartridge TC according to the second exemplary embodiment.

With the cylindrical wall member 14 as described in the first exemplary embodiment, the developer does not necessarily easily flow on the inner circumferential side of the wall member 14 in the case where the developer does not flow to the inner circumferential side from the bottle 1 side, and accordingly, the developer is likely to remain. When the developer remains, the amount of the usable developer in the toner cartridge TC reduces correspondingly. This may lead to reduction of the number of times of printing on sheets. In contrast, with the conical wall member 51 according to the second exemplary embodiment, the developer is easily moved along an inclined surface of the conical shape. This may reduce the amount of the developer remaining on the inner circumferential side of the wall member 51. Thus, an adverse effect on the remaining amount of the developer may be reduced.

Third Exemplary Embodiment

Figure 9:
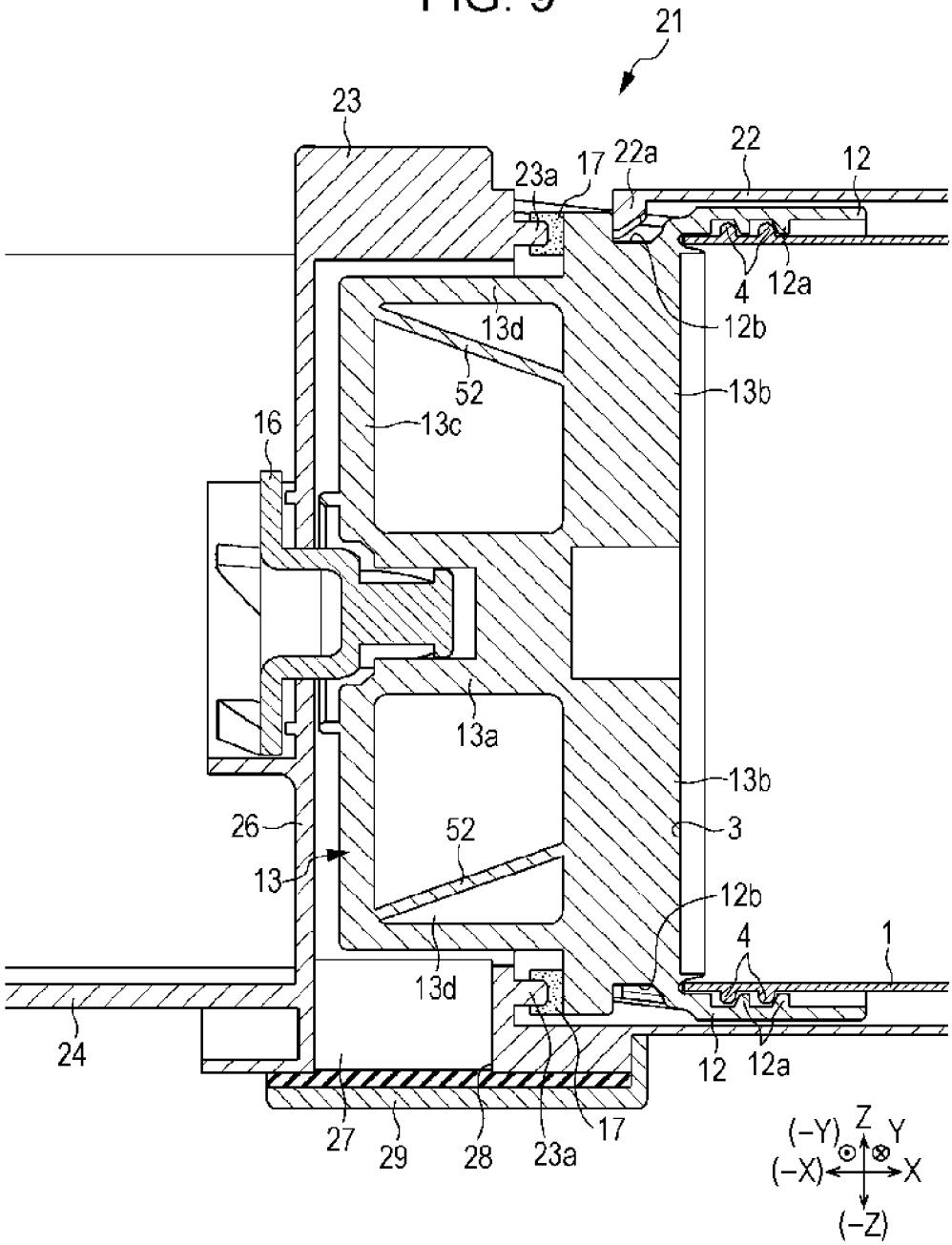
FIG. 9 is for explanation of a toner cartridge according to a third exemplary embodiment and corresponds to FIG. 4 of the first exemplary embodiment.

FIG. 9 is for explanation of the toner cartridge according to a third exemplary embodiment and corresponds to FIG. 4 of the first exemplary embodiment.

Figure 10:
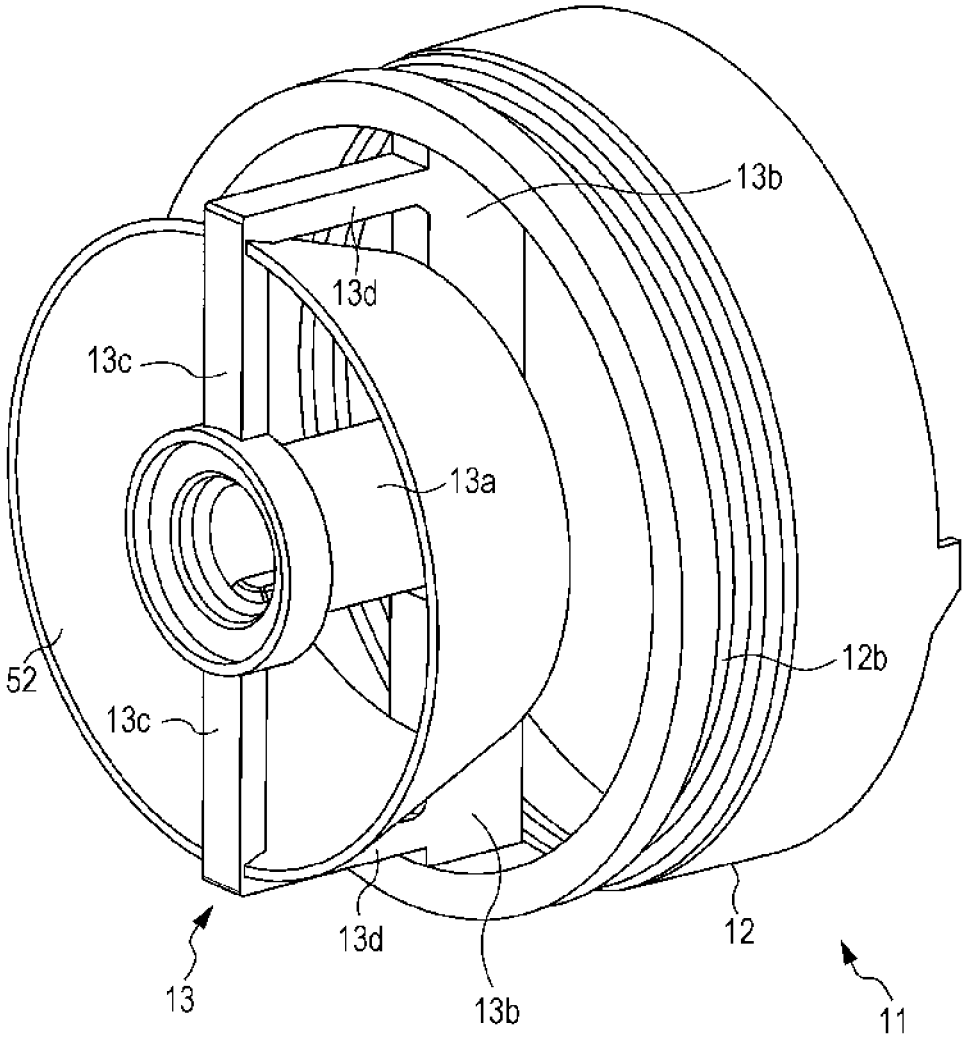
FIG. 10 is an explanatory view of a fin member according to the third exemplary embodiment and corresponds to FIG. 5 of the first exemplary embodiment.

FIG. 10 is an explanatory view of the fin member according to the third exemplary embodiment and corresponds to FIG. 5 of the first exemplary embodiment.

Next, the third exemplary embodiment of the present invention will be described. In this description of the third exemplary embodiment, elements corresponding to those of the first exemplary embodiment are denoted by the same reference signs and detailed description thereof is omitted.

Although the third exemplary embodiment is different from the first exemplary embodiment in the following points, the third exemplary embodiment has a structure that is the same as or similar to that of the first exemplary embodiment in other points.

Referring to FIGS. 9 and 10, the toner cartridge TC according to the third exemplary embodiment includes a conical wall member 52 instead of the cylindrical wall member 14 of the first exemplary embodiment. The diameter of the wall member 52 decreases toward the front thereof. That is, the wall member 52 has the conical shape which is a reversed conical shape of the wall member 51 of the second exemplary embodiment.

With the printer U according to the third exemplary embodiment having the above-described structure, the amount of the developer flowing toward the discharge port 28 is limited more than with a structure not provided with the wall member 52. Accordingly, as is the case with the first exemplary embodiment, the contamination of the interior of the image forming apparatus and the like may be reduced with the toner cartridge TC according to the third exemplary embodiment.

Furthermore, with the toner cartridge TC according to the third exemplary embodiment, the developer is easily moved along an inclined surface of the conical wall member 52 as is the case with the second exemplary embodiment. This may reduce the amount of the developer remaining on the inner circumferential side of the wall member 52.

Fourth Exemplary Embodiment

Figure 11:
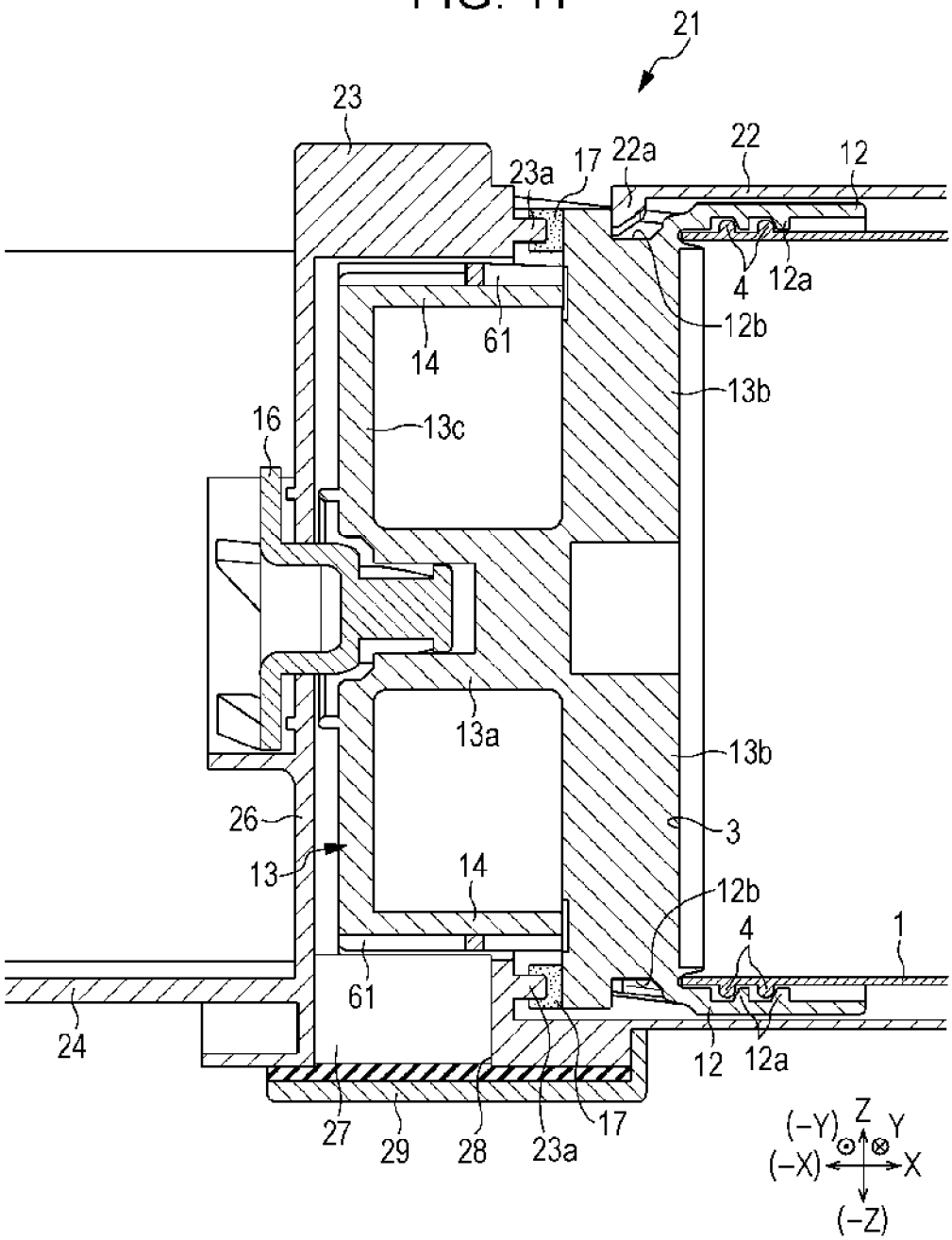
FIG. 11 is for explanation of a toner cartridge according to a fourth exemplary embodiment and corresponds to FIG. 4 of the first exemplary embodiment.

FIG. 11 is for explanation of the toner cartridge according to a fourth exemplary embodiment and corresponds to FIG. 4 of the first exemplary embodiment.

Figure 12:
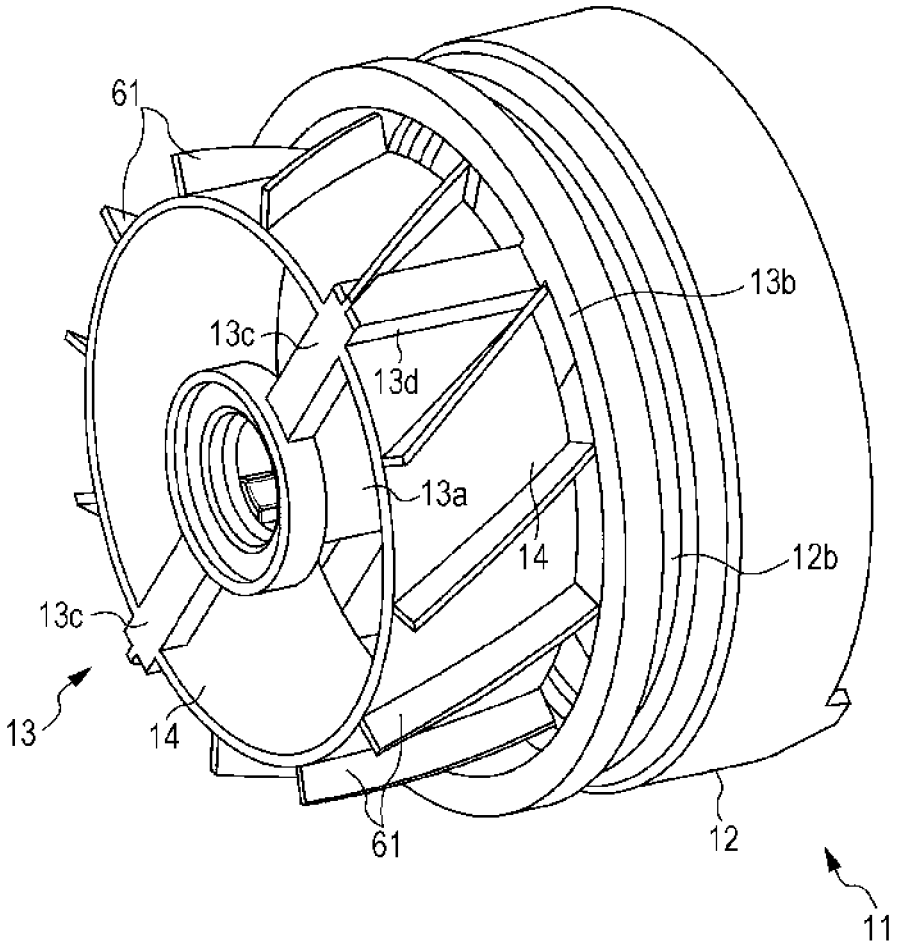
FIG. 12 is an explanatory view of a fin member according to the fourth exemplary embodiment and corresponds to FIG. 5 of the first exemplary embodiment.

FIG. 12 is an explanatory view of the fin member according to the fourth exemplary embodiment and corresponds to FIG. 5 of the first exemplary embodiment.

Next, the fourth exemplary embodiment of the present invention will be described. In this description of the fourth exemplary embodiment, elements corresponding to those of the first exemplary embodiment are denoted by the same reference signs and detailed description thereof is omitted.

Although the fourth exemplary embodiment is different from the first exemplary embodiment in the following points, the fourth exemplary embodiment has a structure that is the same as or similar to that of the first exemplary embodiment in other points.

Referring to FIGS. 11 and 12, regulating plates 61 are supported on an outer circumferential surface of the cylindrical wall member 14, which is similar to or the same as that of the first exemplary embodiment, of the toner cartridge TC of the fourth exemplary embodiment. The regulating plates 61 each serve as an example of a regulating member. The plural regulating plates 61 are spaced apart from one another in the circumferential direction. Furthermore, the regulating plates 61 according to the fourth exemplary embodiment are inclined relative to the axial direction. The regulating plates 61 are inclined in directions so that the developer is transported rearward, that is, toward the discharge channel 27 when the fin member 11 is rotated.

With the printer U according to the fourth exemplary embodiment having the above-described structure, the regulating plates 61 on the outer circumferential surface of the wall member 14 transport the developer toward the discharge channel 27 when the fin member 11 is rotated. According to the first exemplary embodiment, the developer existing between the wall member 14 and the large diameter portion 23 is pushed by the developer transported from the bottle 1 so as to be transported. However, when the amount of the developer in the toner cartridge TC is reduced, the developer is unlikely to be transported. In contrast, according to the fourth exemplary embodiment, the developer is fed by the regulating plates 61. Thus, developer transported to the discharge channel 27 may be easily stabilized.

Furthermore, with the structure according to the first exemplary embodiment, when the toner cartridge TC is detached and inclined with the discharge port 28 facing downward, the developer flows toward the discharge port 28. In contrast, with the toner cartridge TC according to the fourth exemplary embodiment, even when the toner cartridge TC is inclined, the flow of the developer is obstructed by the regulating plates 61. This may reduce the amount of the developer flowing into the discharge port 28.

Fifth Exemplary Embodiment

Figure 13:
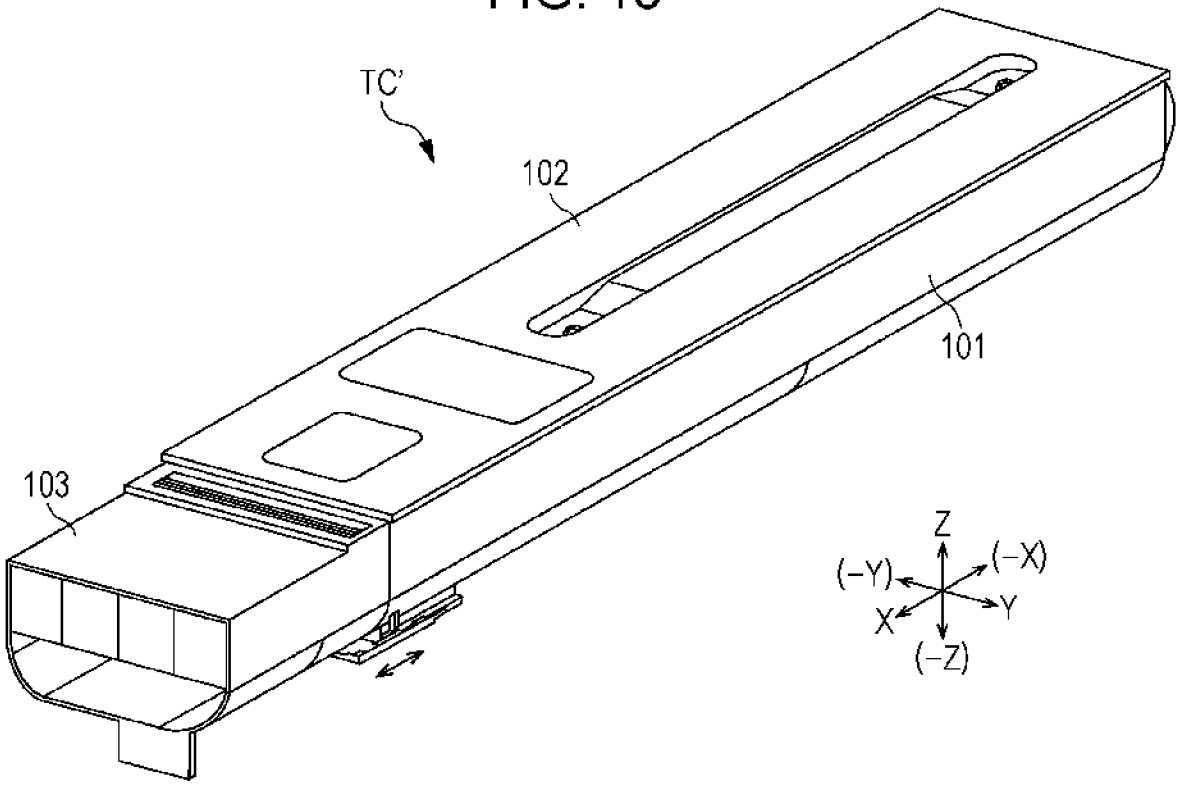
FIG. 13 is a perspective view of a toner cartridge according to a fifth exemplary embodiment.

FIG. 13 is a perspective view of the toner cartridge according to a fifth exemplary embodiment.

Figure 14:
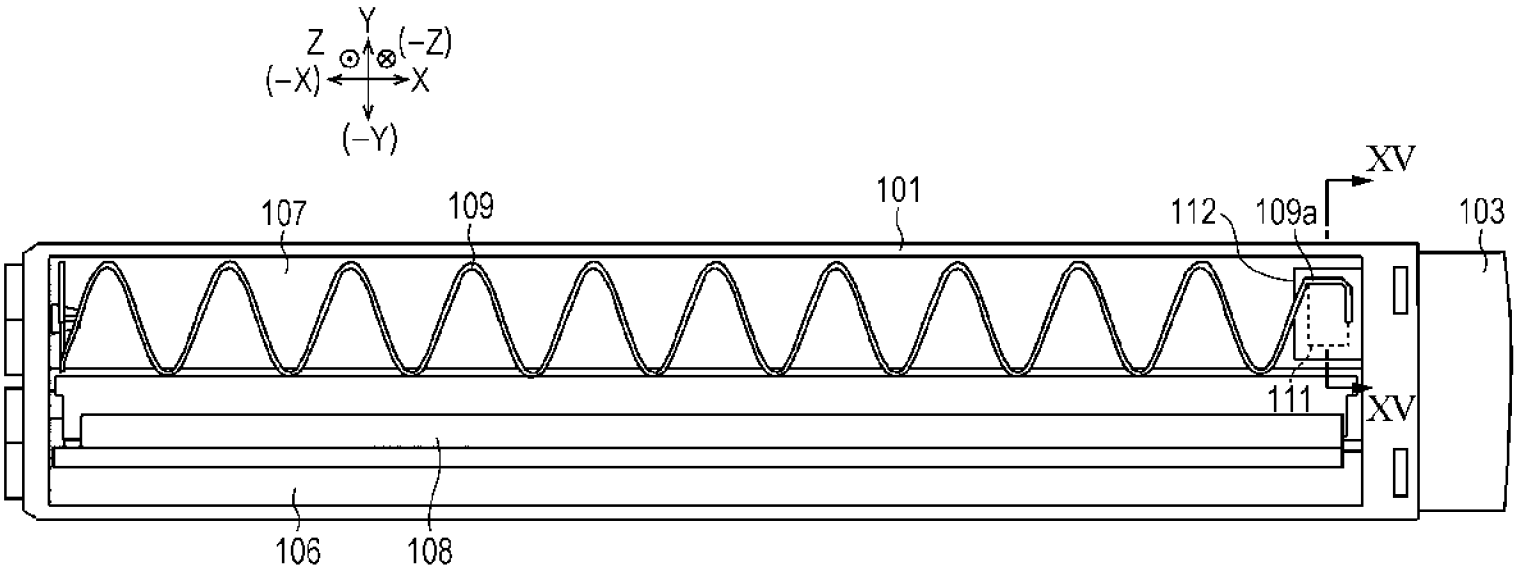
FIG. 14 is an explanatory view of the toner cartridge according to the fifth exemplary embodiment with a lid of the toner cartridge removed.

FIG. 14 is an explanatory view of the toner cartridge according to the fifth exemplary embodiment with a lid of the toner cartridge removed.

Figure 15:
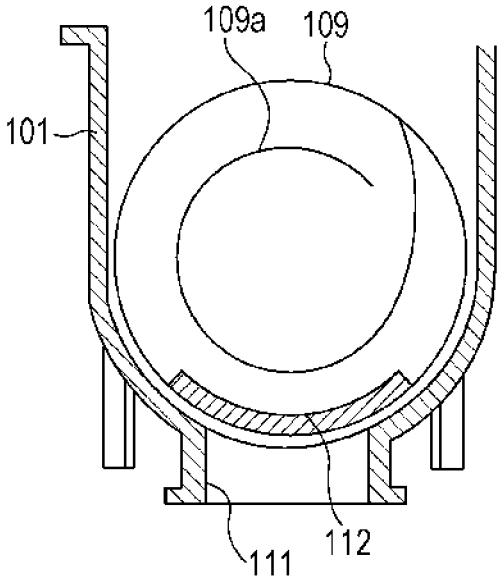
FIG. 15 is a sectional view of the toner cartridge taken along line XV-XV illustrated in FIG. 14.

FIG. 15 is a sectional view of the toner cartridge taken along line XV-XV illustrated in FIG. 14.

Next, the fifth exemplary embodiment of the present invention will be described. In this description of the fifth exemplary embodiment, elements corresponding to those of the first exemplary embodiment are denoted by the same reference signs and detailed description thereof is omitted.

Although the fifth exemplary embodiment is different from the first exemplary embodiment in the following points, the fifth exemplary embodiment has a structure that is the same as or similar to that of the first exemplary embodiment in other points.

Referring to FIGS. 13 to 15, a toner cartridge TC' according to the fifth exemplary embodiment includes a cartridge body 101 that serves as an example of a container body for powder. An upper surface of the cartridge body 101 is covered by a lid member 102. A handle 103 operable by the user is supported at a front end of the cartridge body 101. The cartridge body 101 has a first container space 106 and a second container space 107 therein. A paddle 108 that serves as an example of a transport part is disposed in the first container space 106. The paddle 108 transports the developer in the first container space 106 toward the second container space 107.

An agitator 109 that serves as an example of a transport part is disposed in the second container space 107. The agitator 109 is formed by bending a wire to have a helical shape.

Furthermore, a discharge channel 111 is formed at an end portion of the second container space 107. The developer is discharged through the discharge channel 111. A wall member 112 is formed above the discharge channel 111 so as to cover the discharge channel 111. The wall member 112 according to the fifth exemplary embodiment is secured to and supported by the cartridge body 101.

The agitator 109 according to the fifth exemplary embodiment has a portion 109*a* corresponding to an upper side of the wall member 112. The portion 109*a* generates almost no transport force and is formed to have a shape so as to agitate and level the developer.

With the printer U according to the fifth exemplary embodiment having the above-described structure, as is the case with the first exemplary embodiment, the amount of the developer flowing from a portion above the discharge channel 111 is limited more than with a structure not provided with the wall member 112. Accordingly, as is the case with the first exemplary embodiment, the contamination of the interior of the image forming apparatus and the like may be reduced with the toner cartridge TC' according to the fifth exemplary embodiment.

Variations

Although the exemplary embodiments of the present invention have been described in detail, embodiments of the present invention are not limited to the above-described exemplary embodiments. Many variations are possible without departing from the gist of the present invention described in the claims. Examples of variations (H01 to H08) of the present invention are described below.

H01: According to the above-described exemplary embodiments, the printer is described as the example of the image forming apparatus. However, the image forming apparatus is not limited to the printer. The image forming apparatus is applicable to, for example, an image forming apparatus of any one of a copier, a facsimile machine, and so forth.

H02: According to the above-described exemplary embodiments, an example structure is described in which the flange member 21 is disposed on a leading end side in the mounting direction of the toner cartridge TC, that is, on the rear side of the printer U. However, this is not limiting. For example, a structure is also possible in which the flange member 21 and so forth are disposed on a trailing end side in the mounting direction, that is, on the front side of the printer U.

H03: According to the above-described first to fourth exemplary embodiments, the wall members 14, 51, or 52 may be provided in the fin member 11. However, the wall members 14, 51, or 52 may be provided in the flange member 21.

H04: The structure of the regulating plates 61 according to the fourth exemplary embodiment may be combined with the structure according to the above-described second, third, and fifth exemplary embodiments. Although the regulating plates 61 may be inclined relative to the axial direction according to the fourth exemplary embodiment, the regulating plates 61 may have a shape extending along the axial direction.

H05: According to the first to fourth exemplary embodiments, the fin body 13 may be provided. Alternatively, the fin body 13 may be omitted. Furthermore, although an example structure including two support arms 13*b* is described as the fin body 13, this is not limiting. The fin body 13 may include three or more support arms 13*b*.

H06: According to the above-described first to fourth exemplary embodiments, an example structure is described in which the coupling 16 that drives the bottle 1 is provided at the rear end. However, this is not limiting. For example, a structure is possible in which a coupling form is formed at the front end of the bottle 1 or in which a gear is formed on the outer circumferential surface of the bottle 1 so as to rotate the bottle 1.

H07: Although examples are described in which the toner seal 17 is disposed on the rotating body 1+11 side and the projection 23*a* is disposed on the flange member 21 according to the above-described first to fourth exemplary embodiments, positions of the toner seal 17 and the projection 23*a* may be exchanged.

H08: In the above-described fifth exemplary embodiment, the sum of the numbers of the container spaces 106 and 107 is not limited to two. A structure with a single container space may be provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A container for powder detachably mountable to an image forming apparatus body, the container comprising:

a discharge channel which has an upper end and through which powder is discharged;

a wall member disposed such that a gap is formed between the wall member and the upper end of the discharge channel;

a transport part provided in the container and configured to transport the powder toward the discharge channel;

a container body that contains the powder, the transport part provided in the container body; and a crumbling member connected to the container body, wherein the wall member extends to cover the upper end of the discharge channel along an axial direction of the container, wherein in response to the container body being rotated, the crumbling member also rotates with the container body, and wherein the crumbling member comprises:

a first crumbling part protruding radially inward from an inner surface of the wall member; and a second crumbling part protruding radially outward from an outer surface opposite from the inner surface of the wall member.

2. The container according to claim 1, wherein the container body is rotated when drive is transmitted from the image forming apparatus body, and wherein the container further comprises: a discharge member that supports the container body such that the container body is rotatable relative to the discharge member and that includes the discharge channel.

3. The container according to claim 2, wherein the wall member is supported by the first crumbling part.

4. The container according to claim 3, wherein the wall member is formed entirely around the first crumbling part in a circumferential direction of rotation of the first crumbling part.

5. A container for powder detachably mountable to an image forming apparatus body, the container comprising:

a discharge channel which has an upper end and through which powder is discharged;

a wall member disposed such that a gap is formed between the wall member and the upper end of the discharge channel;

a container body that contains the powder, that has the transport part, and that is rotated when drive is transmitted from the image forming apparatus body;

a discharge member that supports the container body such that the container body is rotatable relative to the discharge member and that includes the discharge channel; and a crumbling part that is disposed corresponding to the discharge channel and that is rotated together with the container body so as to crumble the powder, wherein a transport part that transports the powder toward the discharge channel is provided in the container, wherein the wall member extends to cover the upper end of the discharge channel along an axial direction of the container, wherein the wall member is supported by the crumbling part, wherein the wall member is formed entirely around the crumbling part in a circumferential direction of rotation of the crumbling part, and wherein the wall member is inclined relative to an axial direction of the rotation of the crumbling part.

6. The container according to claim 2, further comprising:

a regulating member that is disposed in the gap between the wall member and the upper end of the discharge channel and that regulates a movement of the powder.

7. The container according to claim 6, wherein the regulating member is inclined relative to an axial direction of the rotation of the crumbling part.

8. An image forming apparatus comprising:

an image holding body having a surface;

a developing device that develops a latent image formed on the surface of the image holding body into a visual image; and the container according to claim 1 that contains the powder with which the developing device is replenished.

9. A container for powder detachably mountable to an image forming apparatus body, the container comprising:

a discharge channel which has an upper end and through which powder is discharged;

a wall member disposed such that a gap is formed between the wall member and the upper end of the discharge channel;

a transport part provided in the container and configured to transport the powder toward the discharge channel;

a container body that contains the powder, the transport part provided in the container body; and a crumbling member connected to the container body, wherein the wall member extends to cover the upper end of the discharge channel along an axial direction of the container, wherein in response to the container body being rotated, the crumbling member also rotates with the container body, wherein the crumbling member comprises a first crumbling part protruding radially inward from an inner surface of the wall member, and wherein the wall member has a conical exterior shape, a diameter of the wall member being decreased toward a rear end of the container in the axial direction of the container.

10. A container for powder detachably mountable to an image forming apparatus body, the container comprising:

a discharge channel which has an upper end and through which powder is discharged;

a wall member disposed such that a gap is formed between the wall member and the upper end of the discharge channel;

a transport part provided in the container and configured to transport the powder toward the discharge channel;

a container body that contains the powder, the transport part provided in the container body; and a crumbling member connected to the container body, wherein the wall member extends to cover the upper end of the discharge channel along an axial direction of the container, wherein in response to the container body being rotated, the crumbling member also rotates with the container body, wherein the crumbling member comprises a first crumbling part protruding radially inward from an inner surface of the wall member, and wherein the wall member has a conical exterior shape, a diameter of the wall member being decreased toward a front end of the container in the axial direction of the container.

* * * * *